United States Patent [19]

Thomas

[11] 4,031,647

[45] June 28, 1977

[54] TITLE PROTECTOR

[76] Inventor: Reta Greenough Thomas, 101 S. Whiting St., No. 407, Alexandria, Va. 22304

[22] Filed: Feb. 10, 1976

[21] Appl. No.: 656,922

[52] U.S. Cl. ..... 40/359; 40/104.19; 229/1.5 R

[51] Int. Cl.[2] ..... B42F 21/00; B65D 27/00

[58] Field of Search ..... 40/359, 360, 78, 78.03, 40/78.11, 124, 124.2, 102, 104.19, 10 D; 229/1.5 R, 68 R, 76, 72, 71; 206/44 B, 45.34, 312

[56] References Cited

UNITED STATES PATENTS

| | | | |
|---|---|---|---|
| 1,774,238 | 8/1930 | Rand | 40/104.19 |
| 2,800,130 | 7/1957 | Wassell | 40/359 |
| 3,446,421 | 5/1969 | Carrigan et al. | 229/72 X |
| 3,933,294 | 1/1976 | Meenan et al. | 229/1.5 R |

*Primary Examiner*—John F. Pitrelli
*Attorney, Agent, or Firm*—John J. Byrne; Edward E. Dyson

[57] ABSTRACT

A title display folder for governing control of printed material which must be retained on a timeless basis. The protector can be affixed to films, pictures, cards, pamphlets or books, for any multiple types of bindings and files. The folder will provide sufficient title territory to make immediately available: sub-titles, index, dates, and the like. The folder is comprised of a single sheet of transparent plastic having a front planar portion having a title display tab extending outwardly therefrom across the top thereof and bottom and rear flaps to completely surround the subject matter filed.

1 Claim, 5 Drawing Figures

TITLE PROTECTOR

The folder described herein relates to an efficient set-up and retrieval of a wide variety of materials that must be permanently retained. The folder is applicable to either automated or manual systems of file retrieval. With very little effort, the folder will permit expeditious conversion of any old controls to newer techniques.

A principal objective of this invention is to provide a folder which does not require a separate identification tag or tab independently provided of the folder itself. In many prior art filing folders, the identification tabs are independently inserted into a display flap. Here, the display flap extends completely across the folder, is integral therewith, and is arranged in such a fashion that the identification and subject matter of the document being filed can be typed directly to the document being filed and received and displayed in a title display area of the subject folder.

Another objective of this invention is to provide a title flap at approximately a 30° angle to the file folder itself so that the title will not be hidden from other files used with this system. A groove is provided in the rear flap of each folder to receive and locate the title flap of a folder placed to the rear thereof.

A further objective of this invention is to provide a transparent file folder which completely surrounds the subject matter of the document being filed. The file folder is constructed so that any portion (or a blank space of the document on which identification data can be typed) can be folded in such a manner that this identification material is displayable.

A still further objective of the invention is to provide a file folder which is in surrounding, protective arrangement with the document being filed.

These and other objects of the invention will become more apparent to those skilled in the art by reference to the following detailed description when viewed in light of the accompanying drawings wherein:

FIG. 1. is a front planar view of a document to be stored by the folder;

Figure 1:
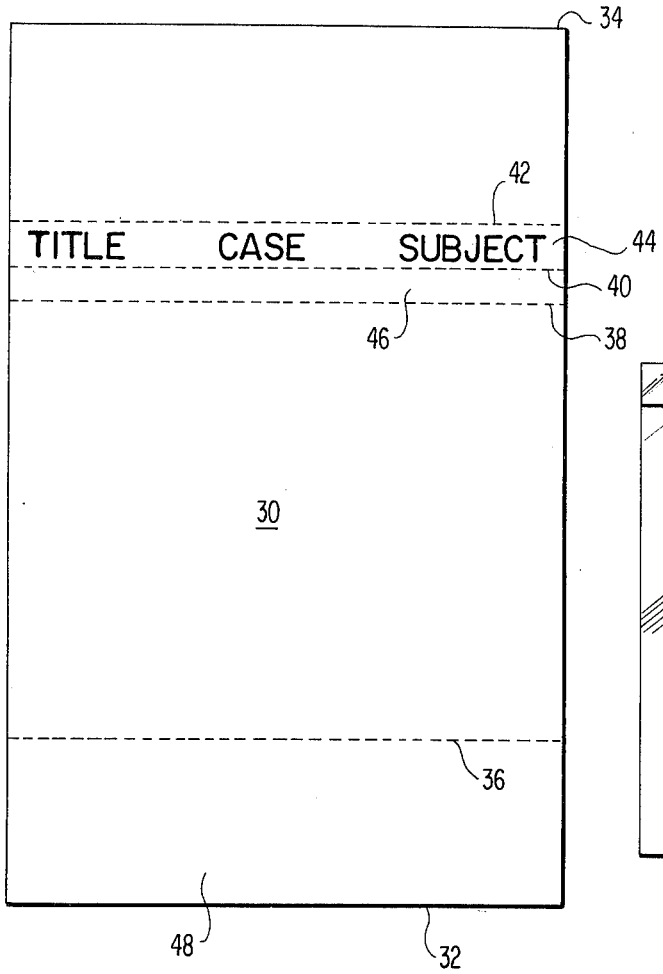
Figure 2:
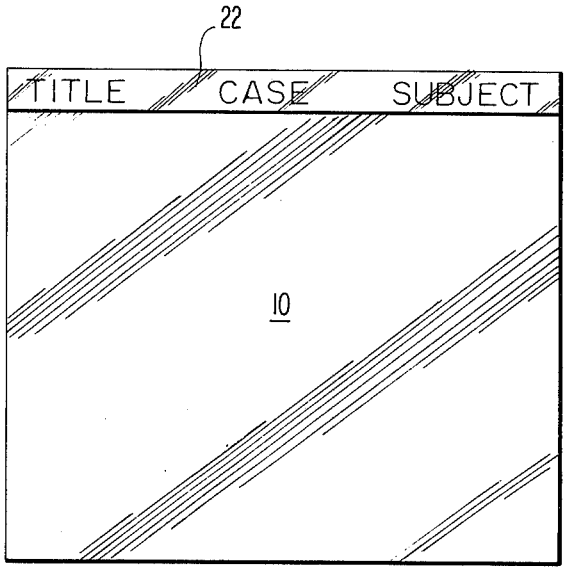
FIG. 2 is a front planar view of the folder of FIG. 1.

Referring now to the drawings wherein like numerals indicate like parts, the numeral 10 indicates the folder of this invention of transparent, flexible material having some resiliency. The folder generally consists of a front panel 12 and a back panel 14. At its bottom edge, the front panel 12 has an upwardly extending flap 16 which provides a pocket 18. As will be seen hereinafter, the pocket 18 receives the bottom edge of a document to be stored.

Figure 5:
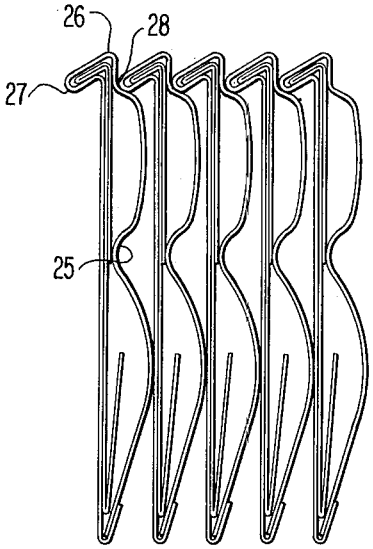
FIG. 5 is an end view of a series of folders juxtaposed in front-to-back alignment.

Extending outwardly from the front panel 12 is a section 20 with a return 22 forming a pocket 24 for the title and indexing data in a manner which will hereinafter be more fully understood. Extending downwardly from the upper edge 26 of the return section 22 in integral relationship therewith is the back flap 14. The title display tab angles downwardly at about 30° from edge 26 and terminates in an outer edge 27. Note that outer edge 27 is vertically below the edge 26. Extending fully across the back panel 14 is a groove or indentation 28 the bottom of which is in the same vertical plane as outer edge 27. As best seen in FIG. 5, when a series of folders are juxtaposed in front-to-back alignment, the outer edges of the title display tabs will rest on the surface of grooves 27. Thus, the display tabs are always maintained visible to a viewer. A second indentation 25 also extends inwardly to contact the rear face of the front panel 12. The indentation 28 will firmly grasp that portion of the document near the title and the indentation 25 will grasp the body portion thereof.

Figure 3:
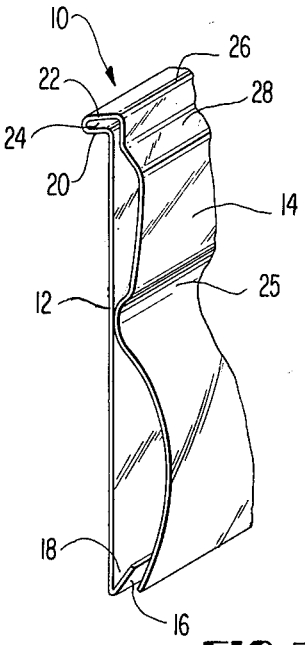
FIG. 3 is a perspective end view of the folder of this invention.
Figure 4:
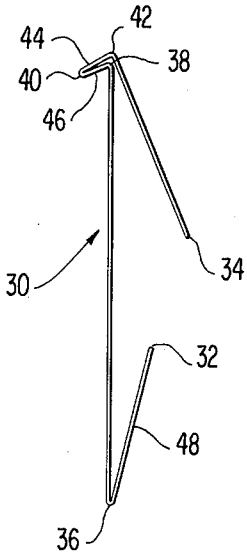
FIG. 4 is a side view of a document properly folded for reception by the folder.

As seen in FIGS. 3 and 4, a document 30 is shown which is of a type to be filed in the folder of this invention. The paper has a bottom edge 32 and a top edge 34. A series of folds are made in the paper at 36, 38, 40 and 42. As seen in FIG. 1, the subject matter which best defines the subject or title of the document is in a panel section 44 defined by folds 40 and 42. This material may be on the document originally or it can be typed on it subsequently for filing purposes. An end view of the folded document is seen in FIG. 3. The depth of panel 44 will be slightly less than the width of the pocket 24 and is inserted endwise therein. The folds 38 and 40 define a panel section 46 and the fold 36 defines a panel 48.

The relative distances of the folds in paper 30 from the top and bottom edges 32 and 34 are determined by the length of that document and the location of the identification subject matter on the document.

It should be understood that the folds 30, 40 and 42 are first made so that the correct subject matter will be displayed under portion 22. The fold 36 is made so that the longitudinal length of the paper is fixed for reception in the transparent folder 10. The identification data, whether it be midway of the document to be stored, at the bottom or top thereof, can still be utilized with the folder 10 by judiciously selecting the folds areas. Likewise, as often happens in modern offices, a new title or new subject matter can be given to a particular document. In other words, when certain documents are combined into a single file, the new identification data can be placed on the sheet at a different distance from the bottom and top and new folds may be made. As can be readily seen, it will not necessitate a new tab or a new tab insertion.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

I claim:

1. A transparent folder for a document to be filed comprising:

a single sheet of transparent plastic including a front planar portion having an upper edge and a bottom edge, a back planar portion coextensive and integral with said front planar portion and having an upper edge joined to said first-mentioned upper edge by a fold and both said front and said back planar portions having free bottom edges, a title display tab extending outwardly from said front panel and formed by sections of said front planar and rear planar portions adjacent to said fold, said back planar portion having a shallow groove parallel to and spaced from said upper edge a distance equal to the vertical distance the outer edge of said title display tab is spaced from said upper edge.

whereby when two or more of said folders are juxtaposed in front-to-back alignment with each other said groove of the frontmost of said folders will receive said outer edge of said tab of the folder located immediately therebehind, a return lip formed on the bottom edge of said front planar portion to receive a bottom edge of said document and the bottom edge of said back planar portion, said document comprises a foldable sheet having a title bearing portion thereon, which title bearing portion may be folded and inserted in said title display tab, and a second groove formed in said back planar portion such that said first and second grooves are in contact with the rear face of said front planar portion.

* * * * *